United States Patent [19]

Katagiri et al.

[11] 4,419,428

[45] Dec. 6, 1983

[54] ELECTROPHOTOGRAPHIC LIGHT-SENSITIVE MEDIA HAVING A DIS-AZO COMPOUND

[75] Inventors: Kazuharu Katagiri; Shozo Ishikawa; Katsunori Watanabe; Shigeto Ohta; Makoto Kitahara, all of Tokyo, Japan

[73] Assignee: Canon Inc., Tokyo, Japan

[21] Appl. No.: 264,799

[22] Filed: May 18, 1981

[30] Foreign Application Priority Data

Jun. 2, 1980 [JP] Japan ..... 55-72752

[51] Int. Cl.[3] ..... G03G 5/06; G03G 5/14

[52] U.S. Cl. ..... 430/77; 430/58; 260/157

[58] Field of Search ..... 430/78, 76, 77; 260/157, 58

[56] References Cited

U.S. PATENT DOCUMENTS

| | | | |
|---|---|---|---|
| 4,141,729 | 2/1979 | Okazaki et al. | 430/78 |
| 4,260,672 | 4/1981 | Sasaki et al. | 430/78 |
| 4,299,896 | 11/1981 | Hashimota et al. | 430/78 |

*Primary Examiner*—John E. Kittle

*Assistant Examiner*—John L. Goodrow

*Attorney, Agent, or Firm*—Staas & Halsey

[57] ABSTRACT

An electrophotographic light-sensitive medium is described comprising at least an electrically conductive layer, a charge generation layer and a charge transport layer, the charge generation layer containing a dis-azo compound represented by Formula (1)

(1)

wherein A represents a single bond, or —CH=CH—;

B represents a coupler having aromatic properties; and R represents a group selected from hydrogen, a halogen and a lower alkyl having 1 to 4 carbon atoms.

14 Claims, No Drawings

ELECTROPHOTOGRAPHIC LIGHT-SENSITIVE MEDIA HAVING A DIS-AZO COMPOUND

BACKGROUND OF THE INVENTION

This invention relates to an electrophotographic light-sensitive medium prepared using a dis-azo compound containing therein two oxadiazole rings.

Various types of light-sensitive media having an electrically conductive layer, and an organic pigment-containing layer provided on the electrically conductive layer, have heretofore been known, including:

(a) a light-sensitive medium as disclosed in Japanese Patent Publication No. 1667/1977 in which a layer prepared by dispersing a pigment in an insulative binder is provided on an electrically conductive layer;

(b) a light-sensitive medium as disclosed in Japanese Patent Application (OPI) Nos. 30328/1972 (corresponding to U.S. Pat. No. 3,894,868) and 18545/1972 (corresponding to U.S. Pat. No. 3,870,516) in which a layer prepared by dispersing a pigment in a charge transport substance or a charge transport medium comprising the charge transport substance and an insulative binder (which may also be a charge transport substance) is provided on an electrically conductive layer;

(c) a light-sensitive medium as disclosed in Japanese Patent Application (OPI) No. 105537/1974 (corresponding to U.S. Pat. No. 3,837,851) which comprises an electrically conductive layer, a charge generation layer containing a pigment, and a charge transport layer; and (d) a light-sensitive medium as disclosed in Japanese Patent Application (OPI) No. 91648/1974 and in which an organic pigment is added to a charge transfer complex.

As pigments for use in light-sensitive media, a number of organic pigments, such as phthalocyanine based pigment, polycyclic quinone based pigment, azo based pigment and quinacridone based pigment, have been proposed, but few of them have been put in practice.

The reason for this is that these organic photoconductive pigments are inferior in sensitivity, durability, etc., to inorganic pigments such as Se, CdS, ZnO, etc.

However, light-sensitive media prepared using inorganic photoconductive pigments also suffer from disadvantages.

For example, with a light-sensitive medium prepared using Se, crystallization of Se is accelerated by heat, moisture, dust, finger print, etc., and, in particular, when the atmospheric temperature of the light-sensitive medium exceeds about 40° C., the crystallization becomes significant, resulting in a reduction in charging properties and the formation of white spots on the image formed. Although Se-based light-sensitive medium can theoretically produce 30,000 to 50,000 copies, it often fails to produce so many copies because it is adversely influenced by the above-stated environmental conditions of the location where the copying machine in which it is used is placed. At the present time, it is generally believed that only about 10,000 copies can be produced by the Se-based light-sensitive medium.

In the case of a CdS-based light-sensitive medium covered with an insulative layer, its durability is nearly the same as that of the Se-based light-sensitive medium. Additionally, use of CdS results in deterioration of the moisture resistance of the CdS-based light-sensitive medium, and it is very difficult to improve this poor moisture resistance. At the present time, therefore, it is necessary to provide an auxiliary means, e.g., a heater.

With a ZnO-based light-sensitive medium, sensitization thereof is caused by the use of dyes exemplified by Rose Bengale and, therefore, problems such as deterioration due to corona charging and discoloration of the dye by light arise.

Furthermore, both the Se-based and CdS-based light-sensitive media are expensive, and cause pollution problems.

The sensitivity of conventional light-sensitive media, when expressed as an exposure amount for half decay ($E\ \frac{1}{2}$), is as follows: a Se-based light-sensitive medium which is not sensitized, about 15 lux·sec; a Se-based light-sensitive medium which is sensitized, about 4 to 8 lux·sec; a CdS-based light-sensitive medium, about the same as that of the sensitized Se-based light-sensitive medium; and a ZnO-based light-sensitive medium, about 7 to 12 lux·sec.

When the light-sensitive medium is used in a PPC (plane paper copier) copying machine (manufactured by Copyer Co., Ltd.), its sensitivity should be 20 lux·sec or less as $E\ \frac{1}{2}$, whereas when used in a PPC copying machine whose rate of duplication is higher, its sensitivity is more desirably 15 lux·sec or less as $E\ \frac{1}{2}$. Of course, light-sensitive media having lower sensitivities than above described can also be used, depending on the purpose for which they are used, i.e., cases where the light-sensitive medium is not necessary to be repeatedly used, such as, for example, cases where the light-sensitive medium is used as a coating paper and a toner image is directly formed on the coating paper in copying of a drawing, etc.

SUMMARY OF THE INVENTION

As a result of extensive investigation to overcome the above-described defects of the conventional inorganic light-sensitive media, and to overcome the above described defects of the organic electrophotographic light-sensitive media heretofore proposed, it has now been found that a light-sensitive medium prepared using a dis-azo compound containing therein two oxadiazole rings has high sensitivity and durability to such an extent that it can satisfactorily be put into practical use, and that it overcomes disadvantages of the inorganic light-sensitive media, e.g., poor heat resistance (crystallization of Se), poor moisture resistance, discoloration by light, pollution, etc.

This invention, therefore, provides an electrophotographic light-sensitive medium comprising a light-sensitive layer containing a dis-azo compound represented by Formula (1)

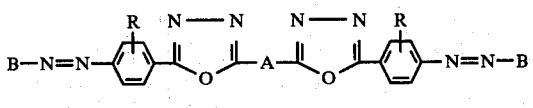

(1)

wherein A represents a single bond,

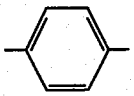

or —CH=CH—;

B represents a coupler having aromatic properties; and R represents a group selected from hydrogen, a halogen and a lower alkyl having 1 to 4 carbon atoms.

DETAILED DESCRIPTION OF THE INVENTION

The oxadiazole ring-containing dis-azo compound which is used in this invention is represented by Formula (1)

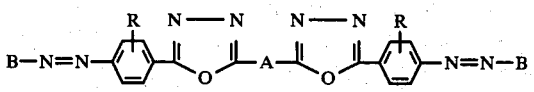

(1)

wherein A represents a single bond,

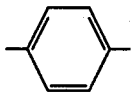

or —CH=CH—;

B represents a coupler having aromatic properties; and R represents a group selected from hydrogen, a halogen and a lower alkyl having 1 to 4 carbon atoms.

The term "a coupler having aromatic properties" referred to herein means an aromatic coupler containing therein a phenolic hydroxy group, such as, for example, a hydroxynaphthoic acid amide type coupler, a hydroxynaphthalic acid imide type coupler and an aminonaphthol type coupler.

Preferably, B is selected from those couplers represented by Formulae (2) to (5)

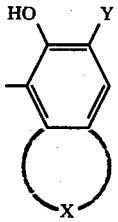

(2)

wherein X represents a group capable of being condensed with the benzene ring of Formula (2) to form a naphthalene ring, an anthracene ring, a carbazole ring or a dibenzofuran ring, and Y is $—CONR_1R_2$ wherein $R_1$ is a group selected from hydrogen, an alkyl group, and a phenyl group, and $R_2$ is a group selected from an alkyl group, a phenyl group, a naphthyl group, a pyridyl group, and a hydrazino group, each of which groups for $R_1$ and $R_2$ may be unsubstituted or substituted.

Examples of the substituents for $R_1$ and $R_2$ include an alkyl group, e.g., methyl, ethyl, etc., a halogen atom, e.g., fluorine, chlorine, etc., an alkoxy group, e.g., methoxy, ethoxy, etc., an acyl group, e.g., acetyl, benzoyl, etc., an alkylthio group, e.g., methylthio, ethylthio, etc., an arylthio group, e.g., phenylthio, etc., an aryl group, e.g., phenyl, etc., an aralkyl group, e.g., benzyl, etc., a nitro group, a cyano group, a dialkylamino group, e.g., dimethylamino, diethylamino, etc., and so forth.

Formula (3)

-continued

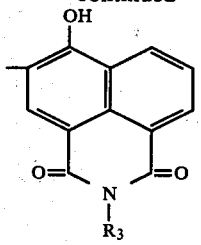

(3)

Formula (4)

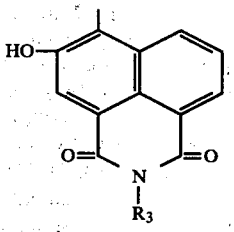

(4)

wherein $R_3$ is a substituted or unsubstituted alkyl group or a substituted or unsubstituted phenyl group.

In more detail, $R_3$ represents an alkyl group, e.g., methyl, ethyl, etc., a hydroxyalkyl group, e.g., hydroxymethyl, hydroxyethyl, etc., an alkoxyalkyl group, e.g., methoxymethyl, ethoxymethyl, ethoxyethyl, etc., a cyanoalkyl group, an aminoalkyl group, an N-alkylaminoalkyl group, an N,N-dialkylaminoalkyl group, a halogenated alkyl group, an aralkyl group, e.g., benzyl, phenethyl, etc., a phenyl group, a substituted phenyl group (examples of such substituents include those described in $R_1$ and $R_2$ of Formula (2)) or the like.

Formula (5)

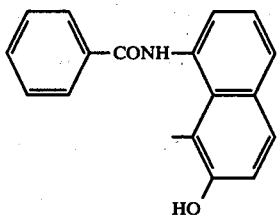

(5)

In Formula (1), R can represent hydrogen, a halogen, e.g., fluorine, chlorine, bromine, or iodine, a lower alkyl group, e.g., methyl, ethyl, propyl, etc. with hydrogen, chlorine and methyl being preferred.

The dis-azo compound represented by Formula (1) can easily be prepared: (a) by tetrazotizing a starting material, e.g., a diamine represented by Formula (6)

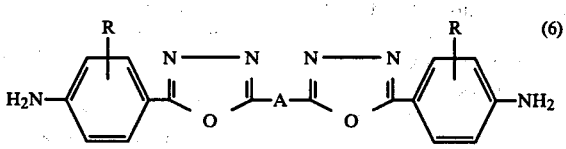

(6)

wherein A and R are the same as described in Formula (1), by the usual procedure (e.g., the method as described in K. H. Saunders, *The Aromatic Diazo Compounds And Their Technical Applications* (1949)) to form the corresponding tetrazonium salt and coupling the tetrazonium salt with the coupler represented either Formula (2), (3), (4), or (5) in the presence of an alkali; or (b), by isolating the tetrazonium salt of the diamine represented by Formula (6) in a boron fluoride or zinc chloride salt form, and then coupling the tetrazonium salt with the coupler represented by Formula (2), (3), (4), or (5) in a suitable solvent, e.g., N,N-dimethylformamide, dimethyl sulfoxide, etc., in the presence of an alkali.

The electrophotographic light-sensitive medium of this invention is a light-sensitive layer containing therein the dis-azo compound represented by Formula (1), and it may be used in any of the types of light-sensitive media of the prior art (a) to (d) as hereinbefore described, as well as in other known types. In order to increase the transport efficiency of charge carriers produced by light-absorption of the dis-azo compound represented by Formula (1), it is desirable to use the dis-azo compound in the light-sensitive medium of the prior art type (b), (c), or (d). The most desirable structure of the light-sensitive medium in which the dis-azo compound of this invention is used is that of the type (c) in which the function of generating charge carriers and the function of transporting the charge carriers are separated, so that the characteristics of the dis-azo compound are most efficiently exhibited.

The following explanation, therefore, is provided with respect to the electrophotographic light-sensitive medium of the optimum structure, i.e., type (c).

An electrically conductive layer, a charge generation layer, and a charge transport layer are essential in the light-sensitive medium. The charge generation layer may be provided either on the charge transport layer or under the charge transport layer. In an electrophotographic light-sensitive medium of the type that is repeatedly used, it is preferred that they are laminated in the order of the electrically conductive layer, the charge generation layer, and the charge transport layer, mainly from a viewpoint of physical strength, and in some cases from a viewpoint of charging properties. For the purpose of increasing the adhesion between the electrically conductive layer and the charge generation layer, if desired, an adhesion layer can be provided therebetween.

As the electrically conductive layer, those having a surface resistance of about $10^{10}\Omega$ or less, preferably, about $10^{7}\Omega$ or less, such as a metal (e.g., aluminum) plate or foil, a metal (e.g., aluminum) vapor deposited plastic film, a sheet prepared by bonding together an aluminum foil and paper, a paper rendered electrically conductive, etc., can be used.

Materials which can be effectively used in forming the adhesion layer include casein, polyvinyl alcohol, water-soluble polyethylene, nitrocellulose and the like. The thickness of the adhesion layer is from about $0.1\mu$ to $5\mu$, and preferably from about $0.5\mu$ to $3\mu$.

Fine particles of the dis-azo compound of Formula (1) are coated, if necessary after being dispersed in a suitable binder, on a charge generation layer or an adhesion layer provided on the electrically conductive layer. The coating techniques, however, are known in the art and are not an integral part of the invention claimed herein. The dispersion of the dis-azo compound can be carried out by known methods, using a ball mill, an attritor or the like. The particle size of the dis-azo compound is usually about $5\mu$ or less and preferably about $2\mu$ or less, with the optimum particle size being $0.5\mu$ or less.

The dis-azo compound can be dissolved in an amine-based solvent, e.g., ethylenediamine and coated. The coating can be performed by known methods, such as blade coating, Meyer bar coating, spray coating, soak coating, etc.

The thickness of the charge generation layer is usually about $5\mu$ or less and preferably from about $0.01\mu$ to $1\mu$. Where a binder is used in the charge generation layer, the proportion of the binder in the charge generation layer is usually about 80% or less, and preferably about 40% or less, because if the amount of the binder is large, the sensitivity of the light-sensitive medium will be adversely affected.

Binders which can be used include polyvinyl butyral, polyvinyl acetate, polyester, polycarbonate, a phenoxy resin, an acryl resin, polyacrylamide, polyamide, polyvinyl pyridine, a cellulose resin, an urethane resin, an epoxy resin, casein, polyvinyl alcohol, etc.

In order to achieve uniform injection of charge carriers from the charge generation layer into the charge transport layer lying on the charge generation layer, if necessary, the surface of the charge generation layer can be ground and planished.

On the charge generation layer so formed is provided the charge transport layer. Where the charge transport substance has no film-forming capability, a binder is dissolved therewith in a suitable solvent and coated by the conventional method to form the charge transport layer. The charge transport substance is divided into an electron transport substance and a positive hole transport substance.

Examples of such electron transport substances include electron attractive substances such as chloranil, bromanil, tetracyanoethylene, tetracyanoquinodimethane, 2,4,7-trinitro-9-fluorenone, 2,4,5,7-tetranitrofluorenone, 2,4,7-trinitro-9-dicyanomethylenefluorenone, 2,4,5,7-tetranitroxanthone, 2,4,8-trinitrothioxanthone, etc., and their polymerization products.

Examples of positive hole transport substances include pyrene, N-ethyl carbazole, N-isopropyl carbazole, 2,5-bis(p-diethylaminophenyl)-1,3,4-oxadiazole, 1-phenyl-3-(p-diethylaminostyryl)-5-(p-diethylaminophenyl)pyrazoline, 1-(pyridyl-(2))-3-(p-diethylaminostyryl)-5-(p-diethylaminophenyl)pyrazoline, 1-(quinolyl-(2))-3-(p-diethylaminostyryl)-5-(p-diethylaminophenyl)pyrazoline, 1-(lepidyl-(2))-3-(p-diethylaminostyryl)-5-(p-diethylaminophenyl)pyrazoline, p-diethylaminobenzaldehyde-N,N-diphenylhydrazone, p-diethylaminobenzaldehyde-N-naphthyl-N-phenylhydrazone, N-methyl-N-phenylhydrazino-3-methylidene-9-ethyl carbazole, N,N-diphenylhydrazino-3-methylidene-9-ethyl carbazole, triphenylamine, poly-N-vinyl carbazole, halogenated poly-N-vinyl carbazoles, polyvinyl pyrene, polyvinyl anthracene, polyvinyl acridine, poly-9-vinylphenyl anthracene, pyrene-formaldehyde resins, ethyl carbazole-formaldehyde resins, etc.

Charge transport substances which can be used are not limited to the above-described ones, and they can be used alone or in combination with each other. The thickness of the charge transport layer is usually from about $5\mu$ to $30\mu$, and preferably from about $8\mu$ to $20\mu$.

Binders which can be used include an acryl resin, polystyrene, polyester, polycarbonate, etc. As the binders for low molecular weight positive hole transport substances, positive hole transport polymers such as poly-N-vinyl carbazole can be used. On the other hand, as binders for low molecular weight electron transport substances, polymers of electron transport monomers as described in U.S. Pat. No. 4,122,113 can be used.

In the light-sensitive medium comprising the electrically conductive layer, the charge generation layer on the electrically conductive layer, and the charge transport layer on the charge generation layer wherein the charge transport substance is the electron transport substance, the surface of the charge transport layer is required to be charged positively, and when the light-sensitive medium is exposed to light after charging, electrons generated in the charge generation layer are injected into the charge transport layer at exposed areas and then reach the surface of the charge transport layer, neutralizing positive charges thereon, as a result of which a decay of surface potential occurs, and electrostatic contrast is formed between exposed areas and unexposed areas. On developing the thus-formed electrostatic latent image with negatively charged toners, a visible image is obtained. This visible image can be fixed either directly or after being transferred to paper or a plastic film.

Alternatively, the electrostatic latent image may be transferred onto an insulative layer of a transfer paper, and then developed and fixed. The type of the developer, the developing method and the fixing method are not critical, and any known developer, developing method and fixing method can be employed.

On the other hand, when the charge transport layer is composed of a positive hole transport substance, the surface of the charge transport layer is required to be charged negatively, and when the light-sensitive medium is exposed to light after the charging, positive holes generated in the charge generation layer are injected into the charge transport layer at exposed areas and then reach the surface of the charge transport layer, neutralizing the negative charges, as a result of which the decay of surface potential occurs and the electrostatic contrast is formed between exposed areas and unexposed areas. In this case, therefore, it is necessary to use positively charged toners for development of electrostatic latent images.

A light-sensitive medium of type (a) according to the present invention can be obtained by dispersing the dis-azo compound of Formula (1) in an insulative binder solution as used in the charge transport layer of the light-sensitive medium of type (c) and coating the resulting dispersion on an electrically conductive support.

A light-sensitive medium of type (b) according to the present invention can be obtained by dissolving an insulative binder as used in the charge transport substance and charge transport layer of the light-sensitive medium of type (c) in a suitable solvent, dispersing the dis-azo compound of Formula (1) in a solution as above, and by coating the resulting dispersion on the electrically conductive support.

A light-sensitive medium of type (d) according to the present invention can be obtained by dispersing the dis-azo compound of Formula (1) in a solution of a charge transfer complex, which is formed on mixing the electron transport substance described in the light-sensitive medium of type (c) and the positive hole transport substance, and coating the resulting dispersion on the electrically conductive support.

In any type of light-sensitive medium according to the present invention, at least one member selected from the dis-azo compounds represented by Formula (1) is used. If desired, the dis-azo compound of Formula (1) may be used in combination with other compounds as pigments having different light absorption ranges, in order to increase the sensitivity of the light-sensitive medium. Furthermore, for the purpose of obtaining panchromatic light-sensitive media, two or more of the dis-azo compounds may be combined together, or the dis-azo compound may be used in combination with charge generating substances selected from known dyes and pigments.

The electrophotographic light-sensitive medium of this invention can be used not only in an electrophotographic copying machine, but also in other applications wherein electrophotography is utilized, such as in laser printing, CRT (cathode-ray tube) printing, etc. Hereinafter, preparation of the dis-azo compound used in this invention will be explained by reference to the preparation thereof.

SYNTHESIS EXAMPLE

Preparation of Compound No. 1

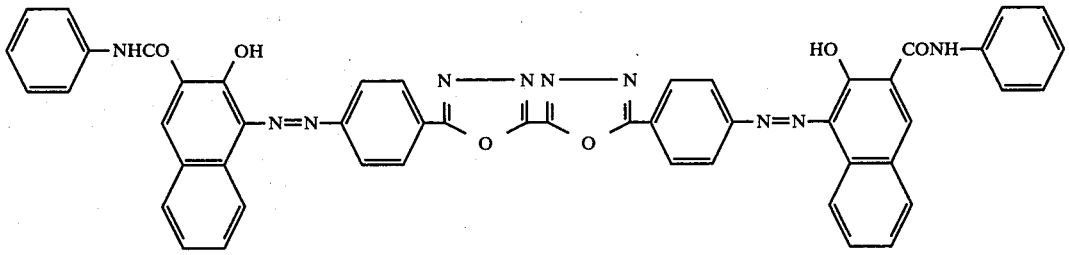

A dispersion consisting of 5.2 g (0.0162 mol) of 5,5'-di(4-aminophenyl)-bis[1,3,4-oxadiazolyl]-2,2' which had been prepared in accordance with the method described in *J. Heterocyclic Chemistry,* 2 (4), 441–6 (1965), 100 ml of water and 9.7 ml (0.11 mol) of concentrated hydrochloric acid was cooled to 5.5° C. A solution prepared by dissolving 2.4 g (0.034 mol) of sodium nitrite in 10 ml of water was dropwise added to the above dispersion over a period of 20 minutes while controlling the temperature at 5.5° C. or lower. After completion of the dropwise addition, the resulting mixture was stirred at that temperature for an additional 15 minutes to obtain a tetrazonium salt solution.

Next, 14.4 g (0.36 mol) of caustic soda and 9.4 g (0.036 mol) of Naphthol S (3-hydroxy-2-naphthoic acid anilide) were dissolved in 400 ml of water, and the above obtained tetrazonium salt solution was dropwise added thereto with stirring over a period of 15 minutes while controlling the temperature within the range of from 5° C. to 10° C. The resulting mixture was stirred for an additional 2 hours and then allowed to stand overnight at room temperature. The reaction solution was filtered to obtain a solid portion which was then washed successively with water and acetone, and dried to obtain 12.1 g of a crude pigment (yield from diamine: 86%). The crude pigment was heat-filtered five times with 400 ml portions of dimethylformamide and one time with acetone, and then dried to obtain 8.6 g of Compound No. 1 (yield from diamine: 61%). The decomposition point was more than 300° C.

Elemental analysis for $C_{50}H_{32}N_{10}O_6$: Calculated (%): C 69.11, H 3.72, N 16.12. Found (%): C 68.97, H 4.02, N 16.01.

IR Absorption Spectrum: Amide 1665 $cm^{-1}$.

Other dis-azo compounds represented by Formula (1) can be synthesized in an analogous manner to the Synthesis Example described above.

The following Examples of electrophotographic media are provided to illustrate this invention in greater detail.

EXAMPLE 1

An aqueous ammonia solution of casein (casein 11.2 g, 28% aqueous ammonia 1 g and water 222 ml) was coated on an aluminum plate with a Meyer bar and dried to form an adhesion layer of a coating amount of 1.0 g/m$^2$.

Next, 5 g of Compound No. 1 and a solution prepared by dissolving 2 g of a butyral resin (degree of butyralation, 63 mol %) in 95 ml of ethanol were ball-milled, and the dispersion so obtained was coated on the adhesion layer with a Meyer bar and dried to form a charge generation layer of a coating amount of 0.2 g/m$^2$.

A solution of 5 g of 1-phenyl-3-(p-diethylaminostyryl)-5-(p-diethylaminophenyl)pyrazoline and 5 g of poly-4,4'-dioxydiphenyl-2,2'-propanecarbonate (molecular weight, 30,000) in 70 ml of tetrahydrofuran was coated on the charge generation layer prepared above and dried to form a charge transport layer of a coating amount of 10 g/m$^2$.

The thus-obtained electrophotographic light-sensitive medium was conditioned at 20° C. and 65% (relative humidity) for 24 hours, corona-charged at −5 KV with an electrostatic copying paper testing apparatus, Model SP-428 produced by Kawaguchi Denki Co., Ltd., according to the static method, and held in a dark place for 10 seconds. Then, the resulting medium was exposed to light at an intensity of illumination of 5 lux, and its charging characteristics were examined.

The results are as follows, wherein $V_o$ (−v), $V_k$ (%) and E ½ (lux.sec.) indicate, respectively, the initial potential, the potential retention in a dark place for the period of 10 seconds, and the exposure amount for half decay.

| | |
|---|---|
| $V_o$ | −540 v |
| $V_k$ | 91% |
| E ½ | 6.9 lux · sec |

-continued

EXAMPLE 2

On a charge generation layer prepared as in Example 1 was coated a solution of 5 g of 2,5-bis(p-diethylaminophenyl)-1,3,4-oxadiazole and 5 g of the same polycarbonate as used in Example 1 in 70 ml of tetrahydrofuran with a Meyer bar so that the coating amount after drying was 10 g/m$^2$.

The thus-obtained light-sensitive medium was measured in charging characteristics in the same manner as in Example 1. The results are as follows:

| | |
|---|---|
| $V_o$ | −555 v |
| $V_k$ | 90% |
| E ½ | 6.8 lux · sec |

EXAMPLE 3

On a charge generation layer prepared as in Example 1 was coated a solution of 5 g of 2,4,7-trinitrofluorenone and 5 g of the same polycarbonate as used in Example 1 in 70 ml of tetrahydrofuran with a Meyer bar so that the coating amount after drying was 12 g/m$^2$.

The thus-obtained light-sensitive medium was measured in charging characteristics in the same manner as in Example 1. The results are as follows:

| | |
|---|---|
| $V_o$ | +570 v |
| $V_k$ | 95% |
| E ½ | 14.5 lux · sec |

In this case, the charging polarity was positive.

EXAMPLES 4 TO 25

5 g of a dis-azo compound (A, B and R of Formula (1) are shown in Table 1), 10 g of a polyester resin solution (Polyester Adhesive 49000, produced by E. I. du Pont; solid content, 20%) and 80 ml of tetrahydrofuran were ball-milled, and the resulting dispersion was coated on an aluminum-deposited Mylar (trademark of E. I. du Pont for polyethylene terephthalate) film at the side of the aluminum surface with a Meyer bar so that the coating amount after drying was 0.3 g/m$^2$.

Next, a solution of 5 g of 1-(lepidyl-(2))-3-(p-diethylaminostyryl)-5-(p-diethylaminophenyl)pyrazoline, and 5 g of the same polycarbonate as used in Example 1 in 70 ml of tetrahydrofuran was coated on the charge generation layer prepared above with a Baker applicator and dried to form 10 g/m$^2$ of a charge transport layer.

The thus-obtained light-sensitive media were measured in charging characteristics in the same manner as in Example 1. The results are shown in Table 2.

TABLE 1
| Example No. | Compound No. | Dis-azo Compound A | B | R* |
|---|---|---|---|---|
| 4 | 1 | — (single bond) | 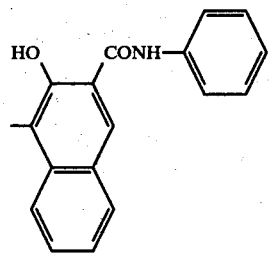 | H |
| 5 | 2 | — | 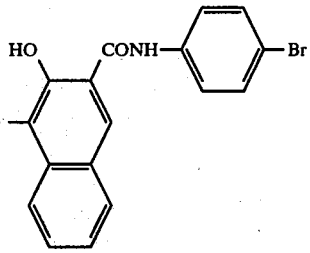 | H |
| 6 | 3 | — | 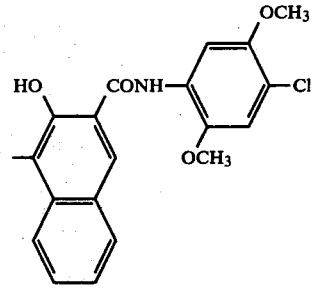 | H |
| 7 | 4 | — | 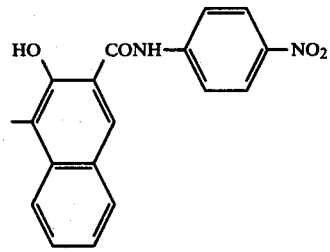 | H |
| 8 | 5 | — | 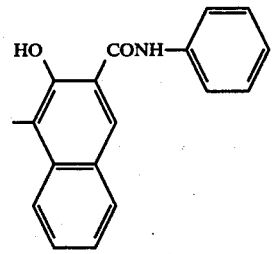 | $CH_3$ (o-position) |

TABLE 1-continued
| Example No. | Compound No. | Dis-azo Compound A | B | R* |
|---|---|---|---|---|
| 9 | 6 | — | 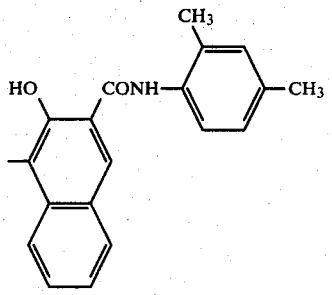 | Cl (m-position) |
| 10 | 7 | 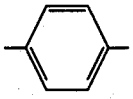 | 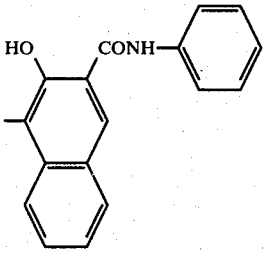 | H |
| 11 | 8 | 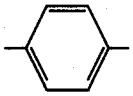 | 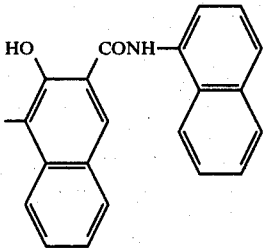 | H |
| 12 | 9 | 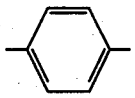 | 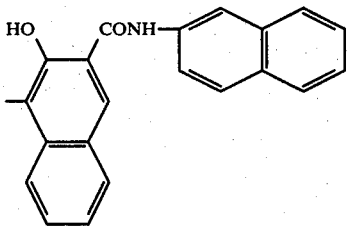 | H |
| 13 | 10 | 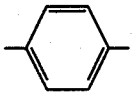 | 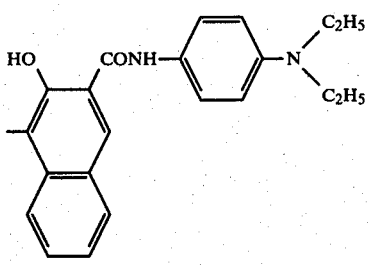 | Cl (m-position) |

TABLE 1-continued
| Example No. | Compound No. | Dis-azo Compound A | B | R* |
|---|---|---|---|---|
| 14 | 11 | 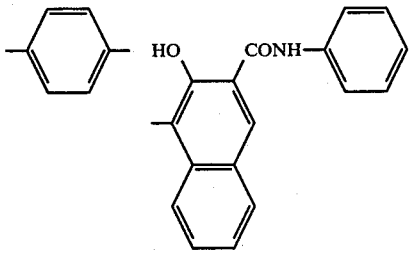 | | $CH_3$ (o-position) |
| 15 | 12 | 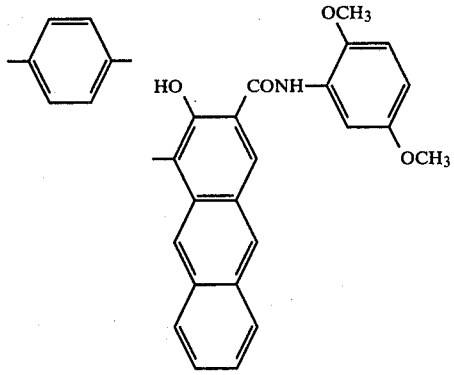 | | $CH_3$ (o-position) |
| 16 | 13 | 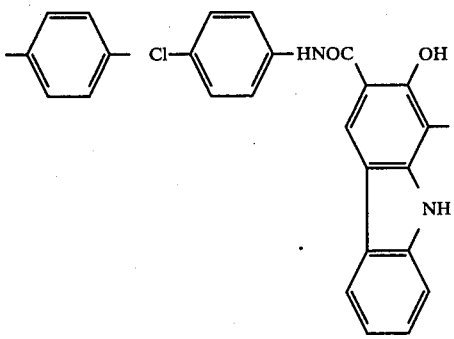 | | $CH_3$ (o-position) |
| 17 | 14 | —CH=CH— | 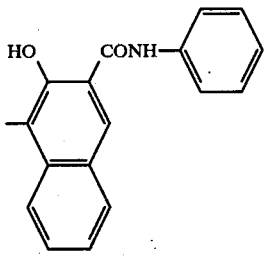 | H |

TABLE 1-continued
| Example No. | Compound No. | Dis-azo Compound A | B | R* |
|---|---|---|---|---|
| 18 | 15 | —CH=CH— | 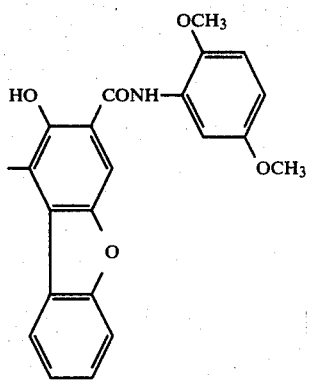 | H |
| 19 | 16 | —CH=CH— | 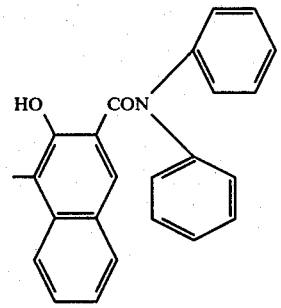 | H |
| 20 | 17 | —CH=CH— | 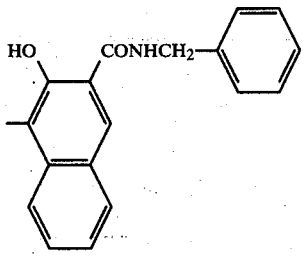 | $CH_3$ (o-position) |
| 21 | 18 | 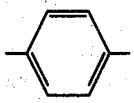 | 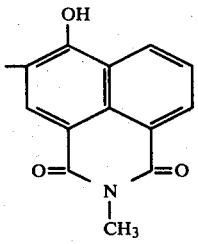 | H |
| 22 | 19 | —CH=CH— | 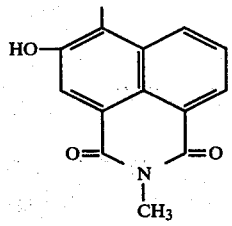 | H |

TABLE 1-continued

| Example No. | Compound No. | Dis-azo Compound A | B | R* |
|---|---|---|---|---|
| 23 | 20 | —CH=CH— | 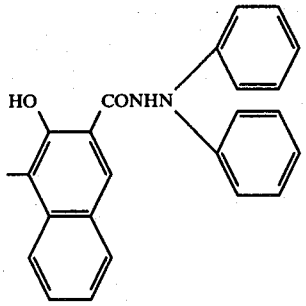 | H |
| 24 | 21 | — | 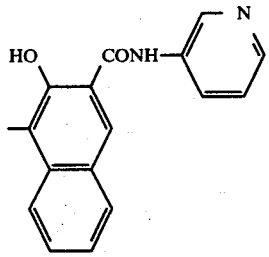 | H |
| 25 | 22 | — | 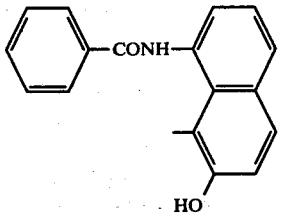 | H |

*The designation in the parenthesis means a position to the azo group.

TABLE 2

| Example No. | Compound No. | Charging Characteristics $V_o$ (−v) | $V_k$ (%) | E ½ (lux · sec) |
|---|---|---|---|---|
| 4 | 1 | 610 | 98 | 8.2 |
| 5 | 2 | 590 | 94 | 8.6 |
| 6 | 3 | 540 | 96 | 8.8 |
| 7 | 4 | 580 | 96 | 11.0 |
| 8 | 5 | 590 | 91 | 7.0 |
| 9 | 6 | 560 | 94 | 8.8 |
| 10 | 7 | 590 | 97 | 7.0 |
| 11 | 8 | 570 | 92 | 8.4 |
| 12 | 9 | 570 | 92 | 9.0 |
| 13 | 10 | 560 | 89 | 11.0 |
| 14 | 11 | 590 | 95 | 6.8 |
| 15 | 12 | 560 | 89 | 10.0 |
| 16 | 13 | 550 | 88 | 9.0 |
| 17 | 14 | 570 | 95 | 8.4 |
| 18 | 15 | 560 | 89 | 9.5 |
| 19 | 16 | 580 | 92 | 12.0 |
| 20 | 17 | 580 | 93 | 10.0 |
| 21 | 18 | 580 | | 8.0 |
| 22 | 19 | 560 | 88 | 8.8 |
| 23 | 20 | 510 | 83 | 15.0 |
| 24 | 21 | 530 | 91 | 14.0 |
| 25 | 22 | 500 | 89 | 13.0 |

EXAMPLE 26

5 g of a compound represented by the formula

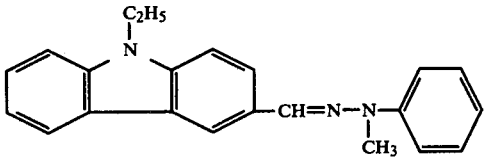

and 5 g of poly-N-vinyl carbazole (molecular weight, 300,000) were dissolved in 70 ml of tetrahydrofuran. To the solution was added 1.0 g of Compound No. 7 shown in Table 1, and the mixture was ball-milled and dispersed. The dispersion so obtained was coated on an aluminum plate provided thereon a casein layer prepared as in Example 1 at the side of the casein layer with a Meyer bar so that the coating amount after drying was 9.5 g/m$^2$.

The thus-obtained light-sensitive medium was measured in charging characteristics in the same manner as in Example 1. The results are as follows:

| | |
|---|---|
| $V_o$ | +510 v |
| $V_k$ | 84% |
| E ½ | 15 lux · sec |

In this case, the charging polarity was positive.

EXAMPLE 27

On an aluminum drum surface there was coated by the dipping method a dispersion prepared by dissolving 200 g of a polyamide resin (Ultramid IC, produced by Bayer AG) in 9.5 l of methanol, adding 500 g of Compound No. 14 shown in Table 1 to the solution and then ball-milling and dispersing the mixture so that the coating amount after drying was 0.25 g/m$^2$. Thereafter, a solution of 500 g of 2,5-bis(p-diethylaminophenyl)-1,3,4-oxazole and 500 g of a polymethyl methacrylate resin dissolved in 7 l of tetrahydrofuran was coated on the charge generation layer and dried to form a charge transport layer of a coating amount of 10 g/m$^2$.

A test piece prepared by subjecting to coating on an aluminum-deposited Mylar film in the same manner as in Example 1 was measured in charging characteristics in the same manner as in Example 1. The results are as follows:

| | |
|---|---|
| $V_o$ | −580 v |
| $V_k$ | 90% |
| $E\frac{1}{2}$ | 8.2 lux · sec |

The thus-obtained drum was mounted on a PPC copying machine (testing apparatus) (produced by Copyer Co., Ltd.) in which a two component developer was used. The surface potential was set to −600 v, and a copying operation was carried out. As the result, excellent quality copies were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive medium having a light-sensitive layer, comprising: fine particles of a dis-azo compound represented by Formula (1)

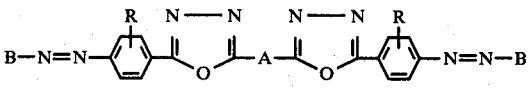

(1)

wherein A represents one of a single bond,

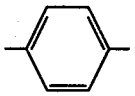

or —CH=CH—;

B represents an aromatic coupler having therein a phenolic hydroxy group; and R is selected from the group consisting essentially of hydrogen, a halogen and a lower alkyl having 1 to 4 carbon atoms.

2. An electrophotographic light-sensitive medium as in claim 1, wherein B is represented by Formula (2)

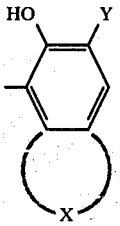

wherein

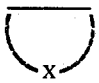

is a ring selected from the group consisting essentially of a benzene ring, a naphthalene ring, an indole ring, and a dibenzofuran ring; Y is —CONR$_1$R$_2$, and wherein R$_1$ is selected from the group consisting essentially of hydrogen, a substituted or unsubstituted alkyl, and a substituted or unsubstituted phenyl, and R$_2$ is selected from a group consisting essentially of a substituted or unsubstituted phenyl, a substituted or unsubstituted naphthyl, a substituted or unsubstituted pyridyl, and a substituted amino.

3. An electrophotographic light-sensitive medium as in claim 1, wherein B is represented by Formula (3) or Formula (4)

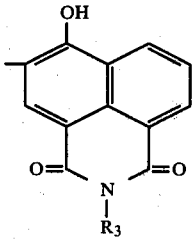

(3)

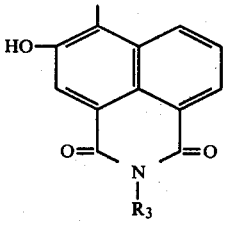

(4)

and wherein R$_3$ is selected from a group consisting essentially of a substituted or unsubstituted alkyl and a substituted or unsubstituted phenyl.

4. An electrophotographic light-sensitive medium as in claim 1, wherein B is represented by Formula (5)

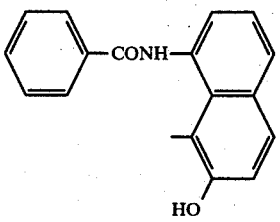

(5)

5. An electrophotographic light-sensitive medium as in claim 2, wherein R is selected from the group consisting essentially of hydrogen, chlorine and methyl.

6. An electrophotographic light-sensitive medium as in claim 1, wherein the dis-azo compound is represented by Formula (6)

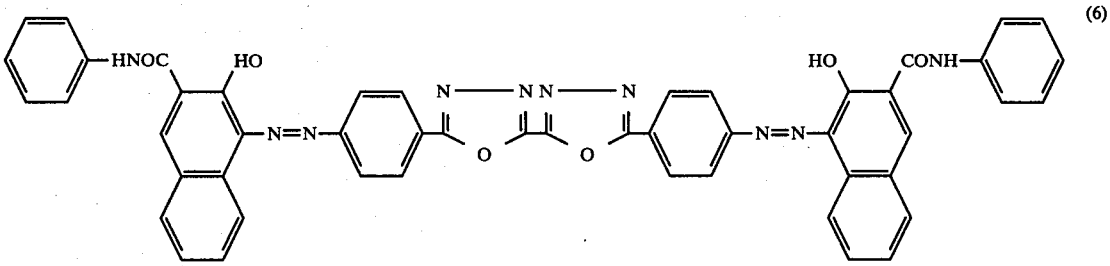

(6)

7. An electrophotographic light-sensitive medium as in claim 1, wherein the dis-azo compound is represented by Formula (7)

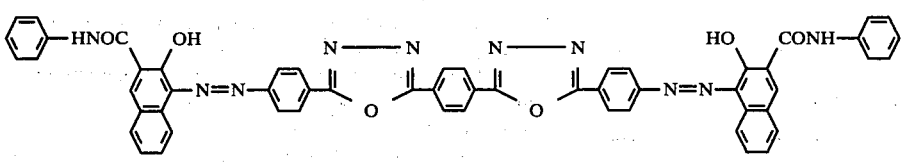

(7)

8. An electrophotographic light-sensitive medium as in claim 1, wherein the dis-azo compound is represented by Formula (8)

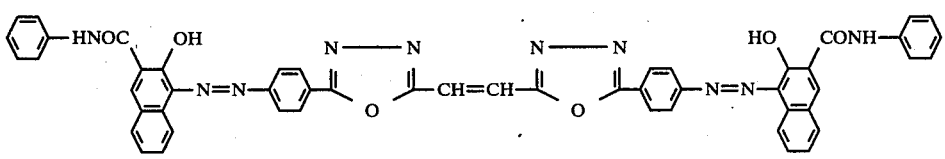

(8)

9. An electrophotographic light-sensitive medium as in claim 1, wherein the dis-azo compound is represented by Formula (9)

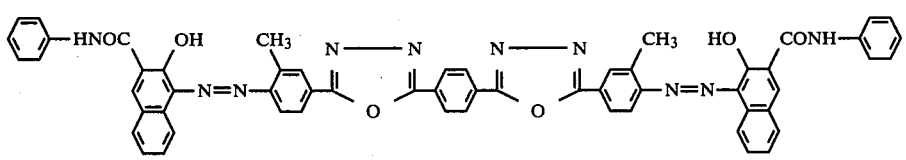

(9)

10. An electrophotographic light-sensitive medium as in claim 1, 2, 3, 4, 5, 6, 7, 8 or 9, wherein the light-sensitive medium further comprises an electrically conductive layer, a light-sensitive charge generation layer containing the dis-azo compound represented by Formula (1), and a charge transport layer.

11. An electrophotographic light-sensitive medium as in claim 10, wherein the electrically conductive layer overlies the charge generation layer, and the charge generation layer overlies the charge transport layer.

12. An electrophotographic light-sensitive medium as in claim 10, wherein the thickness of the charge generation layer is about 5μ or less.

13. An electrophotographic light-sensitive medium as in claim 10, wherein the thickness of the charge generation layer is in the range of about 0.01μ to 1μ.

14. An electrophotographic light-sensitive medium as in claim 1, wherein R is selected from the group consisting essentially of hydrogen, chlorine and methyl.

* * * * *

UNITED STATES PATENT AND TRADEMARK OFFICE

CERTIFICATE OF CORRECTION

PATENT NO. : 4,419,428

DATED : 12/6/83

INVENTOR(S) : KAZUHARU KATAGIRI ET AL.

It is certified that error appears in the above-identified patent and that said Letters Patent is hereby corrected as shown below:

Col.5

Line 2, after "represented" insert --by--;
Line 16, "in order to" should start a new paragraph.

Signed and Sealed this

Tenth Day of April 1984

[SEAL]

Attest:

GERALD J. MOSSINGHOFF

Attesting Officer

Commissioner of Patents and Trademarks